US005459497A

United States Patent [19]

Manning et al.

[11] Patent Number: 5,459,497

[45] Date of Patent: Oct. 17, 1995

[54] INK SUPPLY SYSTEM FOR CONTINUOUS INK JET PRINTER

[75] Inventors: Howard J. Manning; David W. Reed, both of Cambridge, England

[73] Assignee: Domino Printing Sciences PLC, United Kingdom

[21] Appl. No.: 940,943

[22] PCT Filed: May 3, 1991

[86] PCT No.: PCT/GB91/00711

§ 371 Date: Oct. 28, 1992

§ 102(e) Date: Oct. 28, 1992

[87] PCT Pub. No.: WO91/17052

PCT Pub. Date: Nov. 14, 1991

[30] Foreign Application Priority Data

May 3, 1990 [GB] United Kingdom ..... 9009957

[51] Int. Cl.[6] ..... B41J 2/175

[52] U.S. Cl. ..... 347/6; 347/7; 347/89

[58] Field of Search ..... 347/6, 7, 84, 85, 347/89

[56] References Cited

U.S. PATENT DOCUMENTS 3,761,953 9/1973 Helgeson et al. ..... 347/7

3,929,071 12/1975 Cialone et al. ..... 347/89 X 4,555,712 11/1985 Arway et al. ..... 347/7

FOREIGN PATENT DOCUMENTS 0277453 12/1987 European Pat. Off. .

0321677 10/1988 European Pat. Off. .

0354715 8/1989 European Pat. Off. .

*Primary Examiner*—A. T. Grimley

*Assistant Examiner*—Nestor R. Ramirez

*Attorney, Agent, or Firm*—Laff, Whitesel, Conte & Saret, Ltd.

[57] ABSTRACT

An ink supply system for a continuous ink jet printer gun body must allow solvent to be added during printing, and known systems are complex, requiring a pair of pumps, the output pressure of at least one of which is critical. Accordingly, to overcome these problems, an ink supply system for such a printer comprises a pump (9) for pressurising ink and air received from a gutter (8) of the printhead to a pressure above that required for ejection of the ink from the gun body (10) and an ink reservoir (1) from which fresh ink may be fed to the pump (9). The system has first (12) and second (19) chambers in combination with air space (13) and valves (14,15,25), provided for maintaining pressurised air above ink in the first chamber (12) and for controlling the pressure of air above ink in the second chamber (19). Conduit (21) is provided for supplying ink from the second chamber (19) to the printhead.

36 Claims, 1 Drawing Sheet

INK SUPPLY SYSTEM FOR CONTINUOUS INK JET PRINTER

FIELD OF THE INVENTION

The present invention relates to continuous ink jet printers of the kind in which ink under pressure is fed through a nozzle, the ink stream being broken up into small droplets which are then individually charged and deflected in order to print on a substrate moving relative to the nozzle.

BACKGROUND OF INVENTION

A number of problems arise with conventional ink supply systems. The inks that are generally used comprise a pigment and a solvent which tends to evaporate in air, so solvent has to be added continuously during printing. Most conventional systems also utilise a pair of pumps, a first pump being used to pressurise ink and supply it to the printhead, and a second pump being used to pump unused ink away from a gutter system into which uncharged and therefore unutilised droplets are directed. Ink supply systems for conventional printers are frequently complex.

SUMMARY OF THE INVENTION

According to the present invention there is provided an ink supply system for a continuous ink jet printer which includes a printhead having a gun body from which droplets are directed under pressure towards a gutter; the ink supply system includes a

- pump means for pressurising ink and air received from the gutter to a pressure above that required for ejection of the ink from the gun body;
- an ink reservoir from which fresh ink may be fed to the pump means;
- a first chamber to which ink and air are fed from the pump means;
- a means for maintaining the pressure of air, which has passed out of ink in the first chamber, above the ink in the first chamber and for allowing excess air to vent from the first chamber;
- a second chamber to which ink is fed from the first chamber;
- a means for controlling the pressure of air above ink in the second chamber, to pressurise the ink to the pressure required by the printhead; and,
- a means for supplying ink from the second chamber to the printhead.

Preferably, a solvent make-up reservoir is also provided.

In such a system, ink (together with air) entering the gutter is compressed by, for example, a two-stage pump into the first chamber at a pressure higher than that required in the gun body (printhead), the air and ink being separated in the first chamber. Ink from the first chamber can be arranged to pass through a valve and a restrictor to the second chamber substantially at gun body pressure and from the second chamber is fed to the gun body (printhead). The air above the ink in the second chamber is utilised to stabilise the ink feed pressure, this air being supplied from the first chamber via appropriate valving and being vented through a valve when desirable to reduce the pressure.

The system thus provided significantly reduces the amount of solvent lost by evaporation, due to the fact that air entering the gutter can be pressurised to a pressure above atmospheric pressure, for example, 4 bar.

The system has the advantage that a single pump may be provided, the output pressure of which is non-critical to the printing operation. The pump can be arranged to pressurise the ink to high pressure so that air entrained in the ink as it enters the gutter is compressed, thus condensing most of the solvent vapour out of the air and enabling it to be reconstituted in the ink and thus reducing the amount of solvent which needs to be added from time to time. The pump may be as described in our British application no. 9023552.4.

The crucial ink feed pressure can be determined by allowing compressed air to enter the second chamber from the first chamber, or venting air from the second chamber as necessary, or simply by the balance between the feeding of ink from the first chamber to the second chamber (which causes air in the second chamber to be compressed) and the flow of ink from the second chamber. The flow of ink into the second chamber can be determined by the pressure difference between the first and second chambers, a restriction between them and the duty cycle of a valve between the two chambers, and the flow out from the second chamber can be controlled by the air pressure in the second chamber, and the dimensions of the nozzle in the printhead and the pipe or conduit to the printhead. The balance of the flows in and out of the second chamber can be controlled by adjusting flow though the valve between the first and second chambers in accordance with the flow implied by the desired velocity of the jet of ink issuing from the printhead.

Other objects, advantages and novel aspects of the invention will become more apparent in the detailed description, and by reference to the attached drawings.

DETAILED DESCRIPTION OF THE INVENTION

Figure 1:
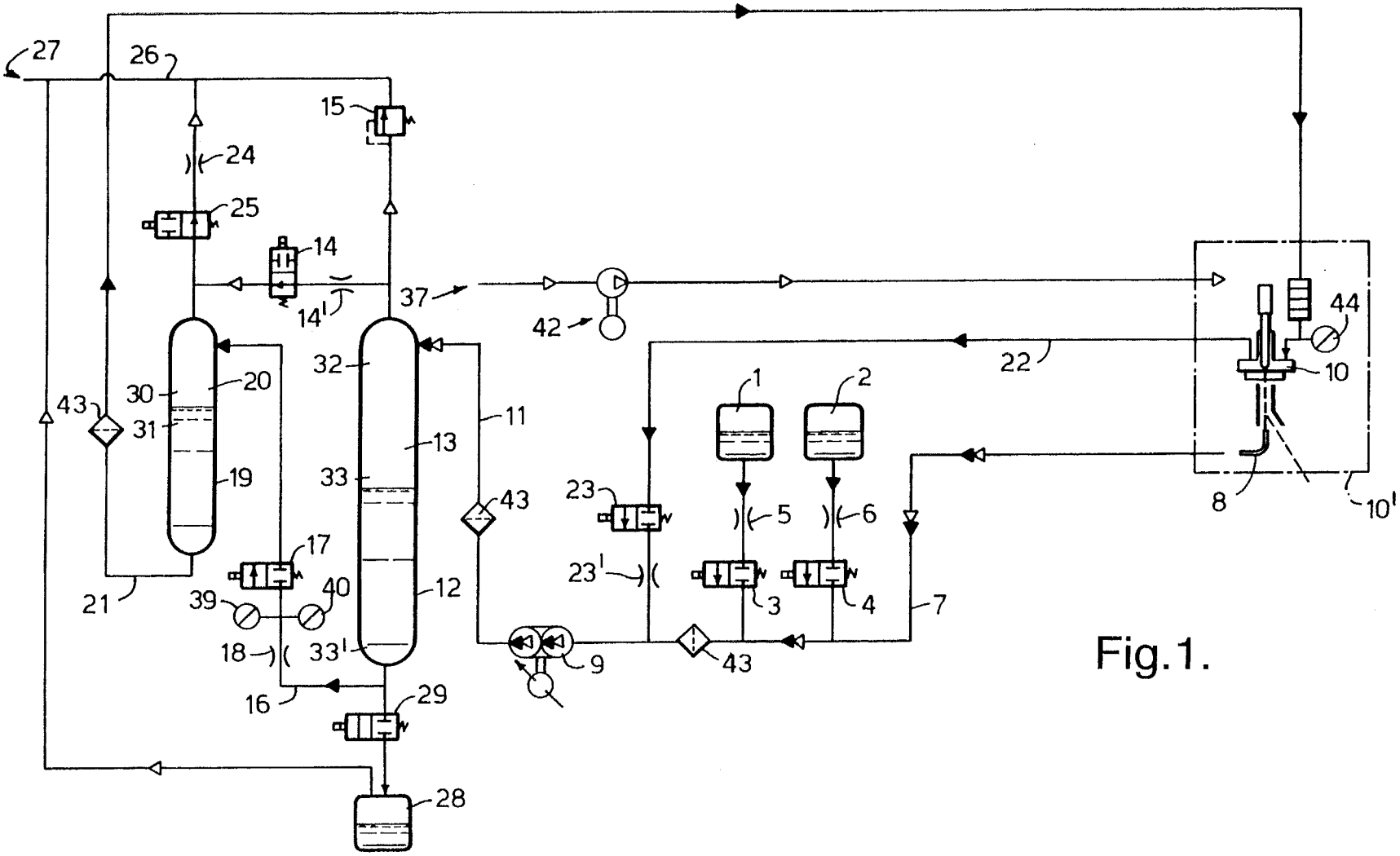
FIG. 1 is a drawing which shows the flow of ink and/or solvent denoted by ▷and the flow of air denoted by ▶for an embodiment of Applicants' ink supply system for a continuous ink jet printer.

Ink is supplied to the system from a reservoir 1 which may be replaced during printing and solvent is added from a second reservoir 2. The reservoirs 1,2 feed ink and solvent make-up (i.e. solvent together with a small volume of ink) respectively through solenoid valves 3 and 4 and restrictions 5 and 6 into a first supply conduit 7. The supply conduit 7 connects a gutter 8 with a two-stage pump 9.

In use, ink is fed to the pump 9 from the gutter 8, the gutter 8 receiving its ink from a gun body 10 in a printhead 10' in the form of droplets Inevitably, air is entrained in the ink as it enters the gutter. The ink is pressurised to a pressure somewhat higher—e.g. 4–6 bar in a first chamber 12 and 2–5 bar in a second chamber 19 (the pressure in the first chamber 12 in any event being higher than that in the second chamber 19)—than that required at the gun body 10 and is then fed through a second conduit 11, to the first chamber 12. Above the ink in the chamber 12 air pressure is maintained in a space 13, air being able to be vented from the space 13 through a restrictor 14' and valves 14, 15, the valve 14 being a solenoid valve and the valve 15 being a pressure relief valve. Ink, under pressure, is fed through a further conduit 16, through a further solenoid valve 17 and a restrictor 18, to the second chamber 19 above which air under pressure is maintained in a space 20. The pressure of air in the space 20 is arranged so that ink in the second chamber 19 is at the correct pressure for passing to the printhead 10' via a further conduit 21.

A bypass flow of ink, through a conduit 22 having a valve 23 and restrictor 23' can flow from the printhead 10 directly to the pump 9, avoiding the gutter 8.

Air is fed from the space 13 through the valve 14 to the space 20 in order to maintain the required air pressure in the space 20, in turn to maintain the required pressure on the ink in the chamber 19. Air that is not required for pressurisation can be allowed to exit through a solenoid valve 25 and a restrictor 24, the air flowing through a conduit 26 to a vent 27. The first chamber 12 opens through a solenoid valve 29 to a dump tank 28, the air space in which is also connected to the vent 27.

In use, the valves 14 and 25 are opened when the ink jet velocity as measured at the printhead by a sensor (not shown) becomes too low or too high respectively. If the jet velocity is too low, air is vented through the valve 14 to allow the passage of air to the space 20 above the second chamber 19 in order to increase air pressure in the space 20 and thus the pressure on the ink in the chamber 19 to maintain the desired jet velocity at the printhead 10'. If the jet velocity is too high, the valve 25 is used to vent air from the space 20 to reduce the air pressure. Multiple iterations of these operations can be used to ensure that the velocity of the ink is maintained substantially constant. It should be noted that the ink jet velocity is more likely to increase than decrease because of the continuous entrainment of air during operation.

An alternative control scheme may use the valve 17 to control the velocity by controlling the passage of ink from the first chamber 12 to the second chamber 19 and valves 14 and 25 to control the level of ink in the second chamber 19 to achieve the correct ink jet velocity. Such a scheme would require frequent operation of each of the valves 14,25,17 rather than merely frequent operation of the valve 17.

The sizing of the second chamber 19 is important in order to reduce pressure fluctuations appearing at the printhead, but a few tens of milliliters is considered sufficient. Since the volume of air in the first chamber 12 can be of a similar order, there are no serious safety implications of the pressurised system.

The addition of solvent from the reservoir 2 can be controlled by operation of the valve 4, solvent being added whenever the viscosity of the ink is too high, such viscosity being determined for example by measuring the pressure difference between the two chambers 12,19 which drives the flow of ink through the restrictor 18, the flow rate through the restrictor 18 when valve 17 is open being deducible from the duty cycle of the valve 17 and the ink jet velocity at the printhead as will be described.

Positioned between the two chambers 12,19 in the conduit 16 are a pressure sensor 39 and a temperature sensor 40. When the valve 17 is closed, the pressure sensor 39 effectively measures the pressure in the first chamber 12, whereas when the valve 17 is open, the pressure transducer 39 effectively measures the pressure in the second chamber 19. When ink is to be passed from the first chamber 12 to the second chamber 19, the valve 17 operates in mark-space fashion so as to pass predetermined quantities of ink. From a knowledge of the mark-space ratio, the jet velocity (measured at the printhead), the pressures in the first and second chambers 12,19, the dimensions of the printhead nozzle, the dimensions of the restrictor 18 and the temperature measured by sensor 40, the viscosity of the ink can be calculated, thus obviating a dedicated viscometer. The determining equation is:

$$\mu = \frac{f(P_p - P_s)D_{res}^4}{32L_{res}d_{jet}^2V_{jet}}$$

where:

f=fraction of time valve (17) open $P_p$=primary pressure $P_s$=secondary pressure $D_{res}$=Diameter of restrictor (18)

$L_{res}$=Length of restrictor (18)

$d_{jet}$=Jet diameter (≡nozzle diameter)

$v_{jet}$=Jet velocity

It will be seen that the system has several safety features. Firstly, the valve 15 is a pressure relief valve, to prevent excessive pressure in the first chamber 12. Secondly, the valves 14 and 25 are normally open so that in the event of a power failure, or on shut-down, the system depressurises automatically and practically immediately.

Ink may be fed as a bypass from the printhead 10 by operation of the valve 23 in order to remove air from the ink.

Air can enter the printhead 10' through a vent 37 under the action of a blower 42. The air may enter the vent 37 from the region of the cabinet which contains the electronic components. Air entering this region is filtered (in order to keep the electronic components clean) and thus can be safely blown into the printhead to provide a positive pressure in the head which in turn prevents the ingress of contaminated air into the printhead from the environment. In addition, this air blown through the printhead is free of solvent, which prevents solvent vapour building up in the printhead.

Alternatively, negative air pressure in the printhead may be employed for the same purpose by omitting the blower 42 and vent 37.

Sensors 32,33, and 33' monitor the level of ink in the first chamber 12, and respectively determine when the level becomes dangerously high, is substantially correct or dangerously low, allowing appropriate measures (such as shut-down when safety is at risk) to be taken, either by automatic electronic control or by alerting a user. Similarly, two sensors 30,31 are provided to measure the ink level is the second chamber 19 to ensure it remains within the limits necessary to produce a stable ink jet.

It will be seen that the pressure of ink in the first chamber is not critical, which makes the manufacture and control of the pump 9 less critical and therefore easier.

The loss of solvent which is a major economic and health problem with conventional systems is reduced for a number of reasons. Firstly, air entering the gutter 8 is pressurised, thus reducing loss by evaporation in the region of the printhead. Secondly, solvent can condense out of the air in both spaces 13, 20 and so be retained in the ink for recirculation to the printhead.

Air is able to escape from the ink in both chambers 12,19, thus maintaining the integrity of the ink and its flow and printing characteristics.

The second chamber 19 and its air space 20 act as a dedicated buffer, resulting in very steady pressure at the gun body 10.

A number of filters can be provided in the conduits of the system in order to ensure that the ink remains clean, and these are shown by way of example at 43. The filters 43 may be a coarse 20 μm filter in the gutter and finer filters, say 3 μm, elsewhere, for example. A temperature transducer 44 is also shown for monitoring and enabling control of the printhead 10'.

We claim:

1. An ink supply system for a continuous ink jet printer which includes a printhead (10') having a gun body (10) from which droplets are directed under pressure towards a gutter (8), the ink supply system comprising:

pump means (9) for pressurizing ink and air received from the gutter (8) to a pressure above that required for ejection of the ink from the gun body (10)

an ink reservoir (1) from which fresh ink may be fed to the pump means (9);

a first chamber (12) to which ink and air are fed from the pump means (9);

means (13,14,14',15,24,25) for allowing air entrained in ink in the first chamber (12) to escape and for maintaining the pressure of said air above the ink in the first chamber (12) and for allowing excess air to vent from the first chamber;

a second chamber (19) to which ink is fed from the first chamber (12);

means (14,14',20,24,25) for controlling the pressure of air above ink in the second chamber (19), to pressurize the ink to the pressure required by the printhead (10); and, means (21) for supplying ink from the second chamber (19) to the printhead.

2. A system according to claim 1, further comprising a solvent make-up reservoir (2).

3. A system according to claim 2, wherein the means for controlling the pressure of air above the ink in the second chamber (19) includes a valve (25) for venting air from above ink in the second chamber (19).

4. A system according to claim 2, wherein the means for controlling the pressure of air above ink in the second chamber (19) includes a conduit and a valve (14) connecting air spaces (13,20) above ink in the first (12) and second (19) chambers.

5. A system according to claim 2, comprising a valve (17) in a conduit (16) through which ink is selectively allowed to pass in use from the first chamber (12) to the second chamber (19).

6. A system according to claim 5, further including a temperature sensor (40) and a restrictor (18) in the conduit (16) through which ink passes in use between the first (12) and second (19) chambers, and a pressure sensor (39) upstream of the valve (17) in said conduit (16).

7. A system according to claim 2 further comprising level sensors (30,31,32,33,33') in each of the first and second chambers (12, 19).

8. A system according to claim 2, further comprising a blower (42) for introducing air through a vent (37) into the printhead (10').

9. A system according to claim 2, further comprising a pressure relief valve (15) for automatically venting air from above the ink in the first chamber (12) when the pressure of that air exceeds a predetermined value.

10. A system according to claim 1 wherein the means for controlling the pressure of air above the ink in the second chamber (19) includes a valve (25) for venting air from above ink in the second chamber (19).

11. A system according to claim 10, wherein the means for controlling the pressure of air above ink in the second chamber (19) includes a conduit and a valve (14) connecting air spaces (13,20) above ink in the first (12) and second (19) chambers.

12. A system according to claim 10, comprising a valve (17) in a conduit (16) through which ink is selectively allowed to pass in use from the first chamber (12) to the second chamber (19).

13. A system according to claim 12, further including a temperature sensor (40) and a restrictor (18) in the conduit (16) through which ink passes in use between the first (12) and second (19) chambers, and a pressure sensor (39) upstream of the valve (17) in said conduit (16).

14. A system according to claim 10 further comprising level sensors (30,31,32,33,33') in each of the first and second chambers (12, 19).

15. A system according to claim 10, further comprising a blower (42) for introducing air through a vent (37) into the printhead (10').

16. A system according to claim 10, further comprising a pressure relief valve (15) for automatically venting air from above the ink in the first chamber (12) when the pressure of that air exceeds a predetermined value.

17. A system according to claim 1, wherein the means for controlling the pressure of air above ink in the second chamber (19) includes a conduit and a valve (14) connecting air spaces (13,20) above ink in the first (12) and second (19) chambers.

18. A system according to claim 17, comprising a valve (17) in a conduit (16) through which ink is selectively allowed to pass in use from the first chamber (12) to the second chamber (19).

19. A system according to claim 18, further including a temperature sensor (40) and a restrictor (18) in the conduit (16) through which ink passes in use between the first (12) and second (19) chambers, and a pressure sensor (39) upstream of the valve (17) in said conduit (16).

20. A system according to claim 17 further comprising level sensors (30,31,32,33,33') in each of the first and second chambers (12, 19).

21. A system according to claim 17, further comprising a blower (42) for introducing air through a vent (37) into the printhead (10').

22. A system according to claim 17, further comprising a pressure relief valve (15) for automatically venting air from above the ink in the first chamber (12) when the pressure of that air exceeds a predetermined value.

23. A system according to claim 1, comprising a valve (17) in a conduit (16) through which ink is selectively allowed to pass in use from the first chamber (12) to the second chamber (19).

24. A system according to claim 23, further including a temperature sensor (40) and a restrictor (18) in the conduit (16) through which ink passes in use between the first (12) and second (19) chambers, and a pressure sensor (39) upstream of the valve (17) in said conduit (16).

25. A system according to claim 24 further comprising level sensors (30,31,32,33,33') in each of the first and second chambers (12, 19).

26. A system according to claim 24, further comprising a blower (42) for introducing air through a vent (37) into the printhead (10').

27. A system according to claim 24, further comprising a pressure relief valve (15) for automatically venting air from above the ink in the first chamber (12) when the pressure of that air exceeds a predetermined value.

28. A system according to claim 23 further comprising level sensors (30,31,32,33,33') in each of the first and second chambers (12, 19).

29. A system according to claim 23, further comprising a blower (42) for introducing air through a vent (37) into the printhead (10').

30. A system according to claim 23, further comprising a pressure relief valve (15) for automatically venting air from above the ink in the first chamber (12) when the pressure of that air exceeds a predetermined value.

31. A system according to claim 1, further comprising level sensors (30,31,32,33,33') in each of the first and second chambers (12,19).

32. A system according to claim 31, further comprising a blower (42) for introducing air through a vent (37) into the printhead (10').

33. A system according to claim 31, further comprising a pressure relief valve (15) for automatically venting air from above the ink in the first chamber (12) when the pressure of that air exceeds a predetermined value.

34. A system according to claim 31, further comprising a blower (42) for introducing air through a vent (37) into the printhead (10').

35. A system according to claim 34, further comprising a pressure relief valve (15) for automatically venting air from above the ink in the first chamber (12) when the pressure of that air exceeds a predetermined value.

36. A system according to claim 1, further comprising a pressure relief valve (15) for automatically venting air from above the ink in the first chamber (12) when the pressure of that air exceeds a predetermined value.

* * * * *